US008651814B2

(12) United States Patent
Nicgorski et al.

(10) Patent No.: US 8,651,814 B2
(45) Date of Patent: Feb. 18, 2014

(54) AXIAL FLOW FAN WITH HUB ISOLATION SLOTS

(75) Inventors: Dana F. Nicgorski, Salem, MA (US); Adam H. Sterne, Boca Raton, FL (US); Michael Strupp, Durmersheim (DE)

(73) Assignee: Robert Bosch GmbH, Stuttgart (DE)

( * ) Notice: Subject to any disclaimer, the term of this patent is extended or adjusted under 35 U.S.C. 154(b) by 0 days.

(21) Appl. No.: 13/414,325

(22) Filed: Mar. 7, 2012

(65) Prior Publication Data

US 2012/0163991 A1 Jun. 28, 2012

Related U.S. Application Data

(63) Continuation of application No. 12/630,122, filed on Dec. 3, 2009, now Pat. No. 8,157,524.

(51) Int. Cl.
*F01D 5/02* (2006.01)
*F01D 5/08* (2006.01)

(52) U.S. Cl.
USPC ..... 416/93 R; 416/203

(58) Field of Classification Search
USPC ..... 415/143; 416/93 R, 169 A, 175, 203, 416/244 R, 248
See application file for complete search history.

(56) References Cited

U.S. PATENT DOCUMENTS

| | | | |
|---|---|---|---|
| 2,114,907 | A | 4/1938 | Oesterlein |
| 3,274,410 | A | 9/1966 | Boivie |
| D206,695 | S | 1/1967 | Dickinson |
| 3,303,995 | A | 2/1967 | Boeckel |
| 3,780,397 | A | 12/1973 | Harbeck et al. |
| 3,815,172 | A | 6/1974 | Fromknect et al. |
| 4,153,389 | A | 5/1979 | Boyd |
| 4,275,321 | A | 6/1981 | Shimamoto et al. |
| 5,071,322 | A | 12/1991 | Maekawa |
| 5,193,981 | A | 3/1993 | Scheidel et al. |
| 5,236,306 | A | 8/1993 | Hozak |
| 5,243,244 | A | 9/1993 | Kasberger et al. |
| 5,307,702 | A | 5/1994 | Spellman et al. |
| 5,352,099 | A | 10/1994 | Anstine et al. |

(Continued)

FOREIGN PATENT DOCUMENTS

| | | |
|---|---|---|
| DE | 9205097 | 8/1993 |
| DE | 102005006183 | 8/2006 |
| FR | 2816380 | 5/2002 |

OTHER PUBLICATIONS

European Search Report dated Jan. 7, 2013 for European Appl. No. 10193404, 6 pages.

*Primary Examiner* — Nathaniel Wiehe
*Assistant Examiner* — Sean J Younger
(74) *Attorney, Agent, or Firm* — Michael Best & Friedrich LLP

(57) ABSTRACT

An axial flow fan includes a hub rotatable about a central axis. The hub includes a front face and a cylindrical portion. A plurality of apertures is provided in the front face of the hub, each aperture at least partially defined by a first surface oriented non-parallel with the front face. A plurality of ribs is provided, each rib aligned with one of the plurality of apertures such that a free edge of the rib at least partially overlaps the respective one of the plurality of apertures. The fan further includes a plurality of lips, each lip coupled to the front face of the hub and aligned with one of the plurality of apertures that is not aligned with one of the plurality of ribs, each lip having a second surface, adjacent the first surface of a respective aperture, that at least partially overlaps the respective aperture.

18 Claims, 8 Drawing Sheets

(56) References Cited

U.S. PATENT DOCUMENTS

| | | | |
|---|---|---|---|
| 5,586,871 | A | 12/1996 | Barnes et al. |
| 5,814,908 | A | 9/1998 | Muszynski |
| 5,818,136 | A | 10/1998 | Matsumoto |
| 5,906,179 | A | 5/1999 | Capdevila |
| 5,929,544 | A | 7/1999 | Maekawa et al. |
| 5,944,497 | A | 8/1999 | Kershaw et al. |
| 6,097,116 | A | 8/2000 | Hess et al. |
| 6,124,660 | A | 9/2000 | Umeda et al. |
| 6,158,985 | A | 12/2000 | Watanabe et al. |
| 6,384,494 | B1 | 5/2002 | Avidano et al. |
| 6,386,276 | B1 | 5/2002 | Chen et al. |
| 6,499,963 | B2 | 12/2002 | Repple et al. |
| 6,514,052 | B2 | 2/2003 | Bostwick |
| 6,563,240 | B2 | 5/2003 | Lin et al. |
| 6,666,660 | B2 | 12/2003 | Kegg et al. |
| 6,798,098 | B1 | 9/2004 | Tai |
| 6,815,849 | B2 | 11/2004 | Serizawa et al. |
| 6,908,284 | B2 | 6/2005 | Adrian |
| 7,001,156 | B2 | 2/2006 | Chen |
| 7,015,606 | B2 | 3/2006 | Huang et al. |
| 7,034,416 | B2 | 4/2006 | Simofi-Ilyes et al. |
| 7,078,834 | B2 | 7/2006 | Liu |
| 7,122,924 | B2 | 10/2006 | Lee |
| 7,132,772 | B2 | 11/2006 | Takeuchi et al. |
| 7,157,818 | B2 | 1/2007 | Jones |
| 7,300,262 | B2 | 11/2007 | Ku et al. |
| 7,345,386 | B2 | 3/2008 | Dano et al. |
| 7,374,408 | B2 | 5/2008 | Savage et al. |
| 7,385,322 | B2 | 6/2008 | Park |
| 7,455,502 | B2 | 11/2008 | Spaggiari |
| 2004/0223845 | A1 | 11/2004 | Caplan et al. |
| 2005/0067500 | A1 | 3/2005 | Hong et al. |
| 2005/0134129 | A1 | 6/2005 | Sato et al. |
| 2006/0103245 | A1 | 5/2006 | Simofi-Ilyes et al. |
| 2007/0152519 | A1 | 7/2007 | Jarrah et al. |
| 2007/0253814 | A1 | 11/2007 | Lee et al. |
| 2007/0280827 | A1 | 12/2007 | Stevens et al. |
| 2007/0280829 | A1 | 12/2007 | Stevens et al. |
| 2007/0286727 | A1 | 12/2007 | Chang et al. |
| 2008/0079324 | A1 | 4/2008 | Aoshima |
| 2009/0015082 | A1 | 1/2009 | Hosoi et al. |
| 2009/0104053 | A1 | 4/2009 | Franz |

AXIAL FLOW FAN WITH HUB ISOLATION SLOTS

RELATED APPLICATIONS

This application is a continuation of U.S. patent application Ser. No. 12/630,122 filed Dec. 3, 2009, the entire content of which is hereby incorporated by reference.

FIELD OF THE INVENTION

The present invention relates to axial flow fans, and more particularly to axial flow fans for use in vehicle engine-cooling systems.

BACKGROUND OF THE INVENTION

Typical vehicle engine-cooling systems include an electric motor and an axial flow fan coupled to an output shaft of the motor. Axial flow fans typically include a hub coupled to the output shaft of the motor and a plurality of blades extending radially from the hub. The hub of the axial flow fan is typically shaped to allow the motor to be at least partially recessed into the hub to reduce the space requirement of the assembled motor and axial flow fan. A plurality of radially-extending ribs are also typically incorporated with the hub to stiffen the structure of the axial flow fan. If a ventilated or air-cooled motor is employed, the ribs may also help cool the motor by functioning as a centrifugal fan to pull cooling air through the motor.

Axial flow fans are often designed to minimize noise and vibration during operation. Some vehicle engine-cooling systems may suffer from higher than desirable levels of noise, vibration, and harshness ("NVH") caused by, for example, motor cogging torque, axial cogging forces, torque ripple, and axial ripple forces which can excite resonant modes in the structure of the axial flow fan. To reduce the NVH caused by the axial flow fan, isolation apertures or slots are often formed in the hub of the axial flow fan.

SUMMARY OF THE INVENTION

When using isolation apertures or slots in the hub, however, small amounts of water or other liquids may pass through the isolation slots during operation of the vehicle and contact the motor recessed within the hub, potentially causing damage to the motor.

The invention provides, in one aspect, an axial flow fan including a hub rotatable about a central axis. The hub includes a front face and a cylindrical portion. The axial flow fan also includes a plurality of blades extending radially outwardly from the cylindrical portion of the hub. A plurality of apertures is provided in the front face of the hub, each aperture at least partially defined by a first surface oriented non-parallel with the front face. The fan further includes a plurality of ribs, each rib extending radially along an interior surface of the front face of the hub and aligned with one of the plurality of apertures such that a free edge of the rib at least partially overlaps the respective one of the plurality of apertures and provides a tortuous passageway through the respective aperture. The fan further includes a plurality of lips, each lip coupled to the front face of the hub and aligned with one of the plurality of apertures that is not aligned with one of the plurality of ribs, each lip having a second surface, adjacent the first surface of a respective aperture, that at least partially overlaps the respective aperture and provides a tortuous passageway through the aperture.

Other features and aspects of the invention will become apparent by consideration of the following detailed description and accompanying drawings.

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways. Also, it is to be understood that the phraseology and terminology used herein is for the purpose of description and should not be regarded as limiting.

DETAILED DESCRIPTION

Figure 1:
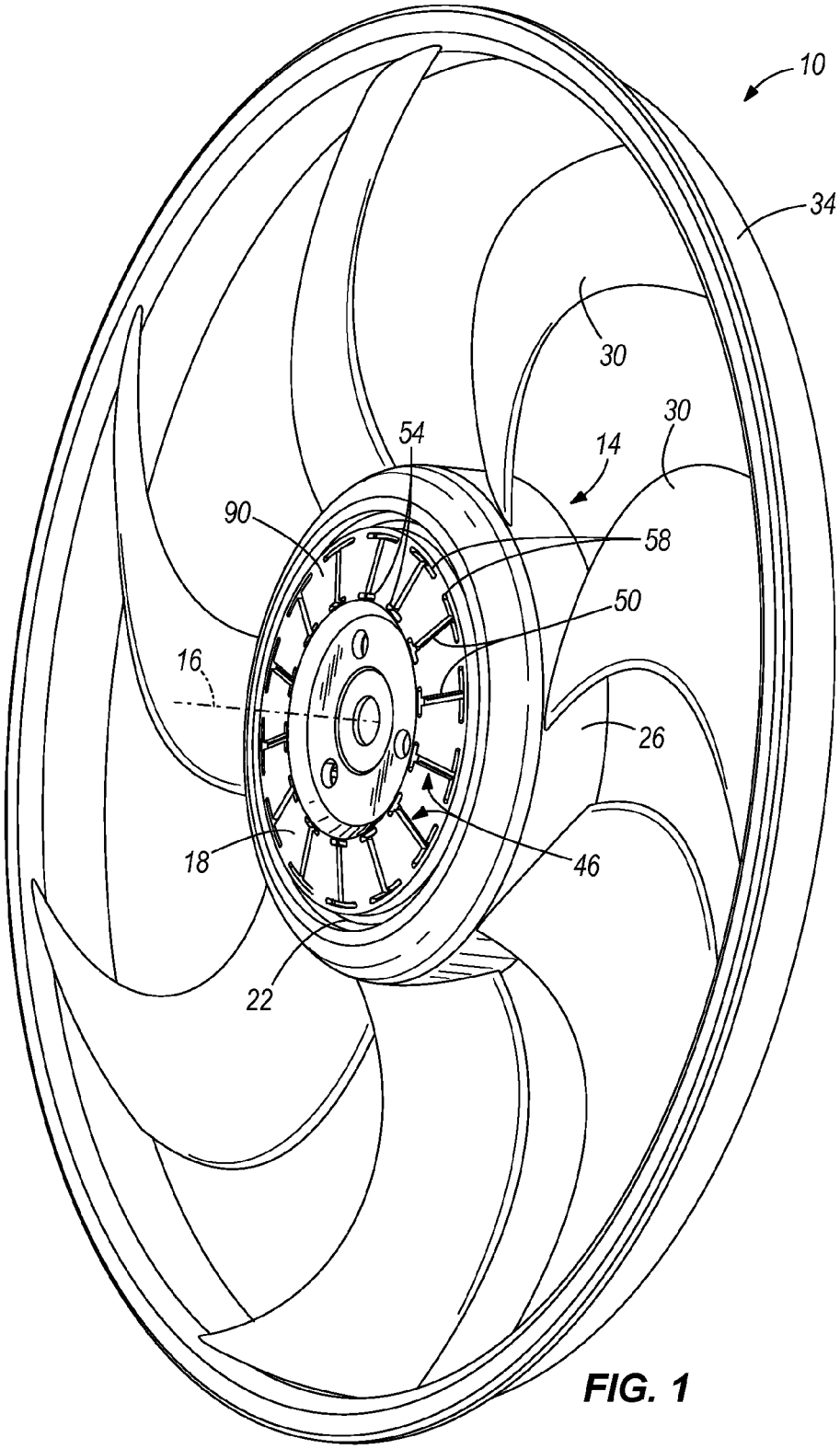
FIG. 1 is a front perspective view of a first construction of an axial flow fan of the invention.

FIG. 1 illustrates a first construction of an axial flow fan 10 of the invention. Although not shown, the fan 10 may be coupled to an output shaft of a motor (e.g., an electric motor) which, in turn, may be supported by a fan shroud or another component in the vehicle engine-cooling system in which the fan 10 is utilized. The fan shroud may be positioned adjacent a heat exchanger (e.g., a radiator), such that rotation of the fan 10 about a central axis 16 generates an airflow through the heat exchanger.

The fan 10 includes a hub 14 having a front face 18 that extends in a generally radial direction with respect to the central axis 16, and is coupled to the output shaft of the motor for co-rotation with the output shaft. The front face 18 may be coupled to the motor output shaft using any of a number of components and methods known in the art (e.g., using fasteners or clips, by welding, using adhesives, using an interference or press-fit, etc.). Further, the front face 18 of the hub 14 may be coupled directly to the motor output shaft, or an adapter may be used between the front face 18 of the hub 14 and the motor output shaft. Although the front face 18 of the hub 14 is illustrated as having a draft angle and a circumferential groove 22 formed therein (see also FIG. 5), the front face 18 may alternatively be substantially flat or planar, and the groove 22 may be omitted.

With reference to FIG. 1, the hub 14 also includes a cylindrical portion 26 extending axially from the front face 18, in the direction of the central axis 16. Although not shown, the motor is at least partially recessed into the hub 14 when attached to the fan 10, such that the cylindrical portion 26 of the hub 14 at least partially overlaps the motor housing. Alternatively, the motor may be coupled to the fan 10 such that the motor is not recessed into the hub 14. With continued reference to FIG. 1, the fan 10 also includes a plurality of blades 30 extending radially outwardly from the cylindrical portion 26 of the hub 14. The tips of the blades 30 are interconnected by a band 34 extending circumferentially around the fan 10. The band 34 may help stabilize the tips of the blades 30 during rotation of the fan 10, however, the band 34 may be omitted in alternative constructions of the fan 10.

Figure 2:
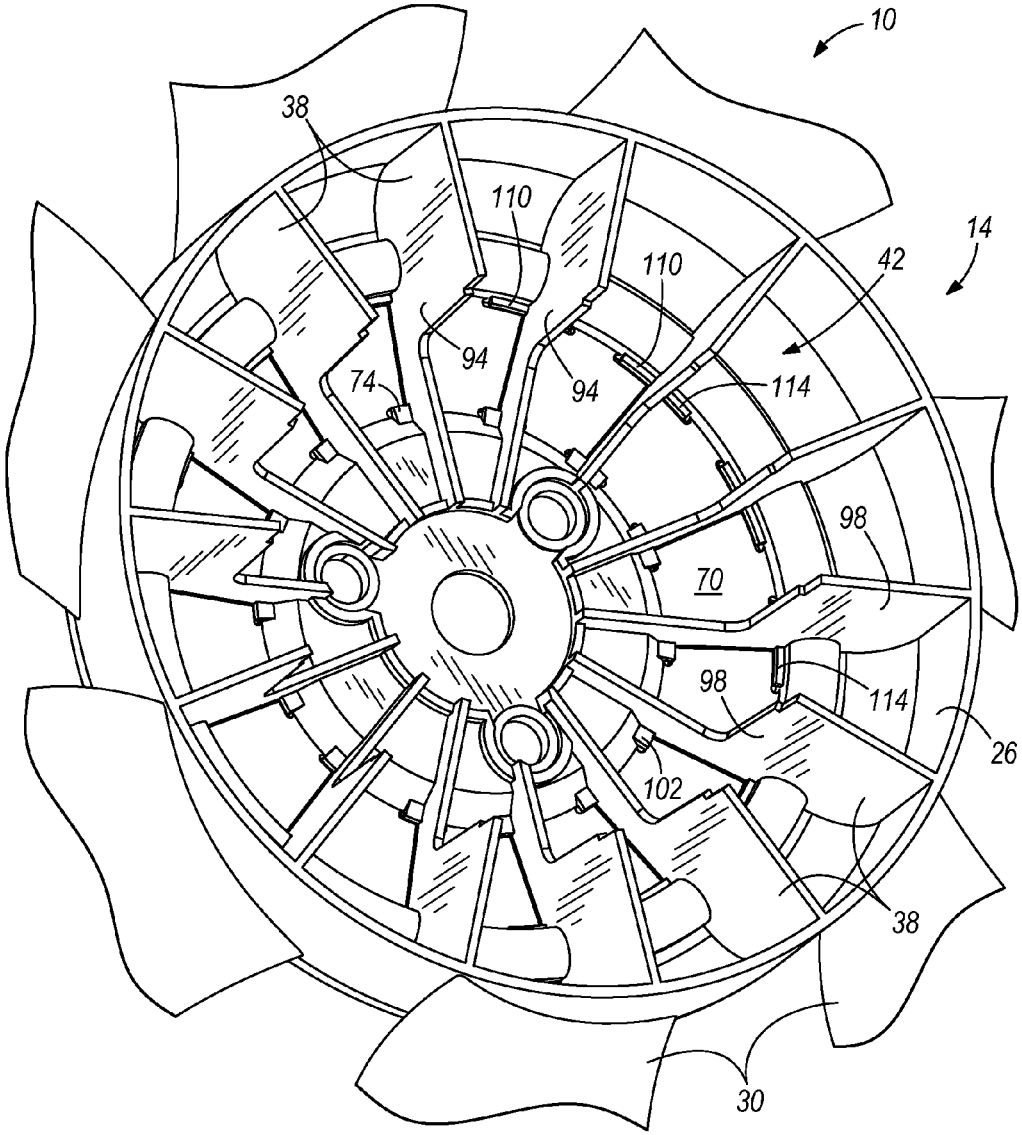
FIG. 2 is a rear perspective view of a portion of the axial flow fan of FIG. 1.

With reference to FIG. 2, the fan 10 further includes a plurality of ribs 38 coupled to the hub 14 and arrayed about the central axis 16. Specifically, the ribs 38 extend from an interior side 42 of the hub 14, and extend both in a radial direction along the front face 18 and in an axial direction along the cylindrical portion 26 of the hub 14. As such, the ribs 38 are generally L-shaped as shown in FIG. 2, however, other shapes may be utilized to conform with the shape of the hub 14. In the illustrated construction of the axial flow fan 10, the ribs 38 are evenly distributed about the hub 14 to structurally reinforce the front face 18 and the cylindrical portion 26 of the hub 14. Alternatively, the ribs 38 may be unequally or irregularly spaced or distributed about the hub 14. In addition, the ribs 38 function as centrifugal fan blades when the fan 10 is rotated to generate an airflow through or around the motor to cool the motor. Alternatively, the ribs 38 may be primarily configured to generate an airflow through or around the motor, without structurally reinforcing the hub 14.

Figure 3:
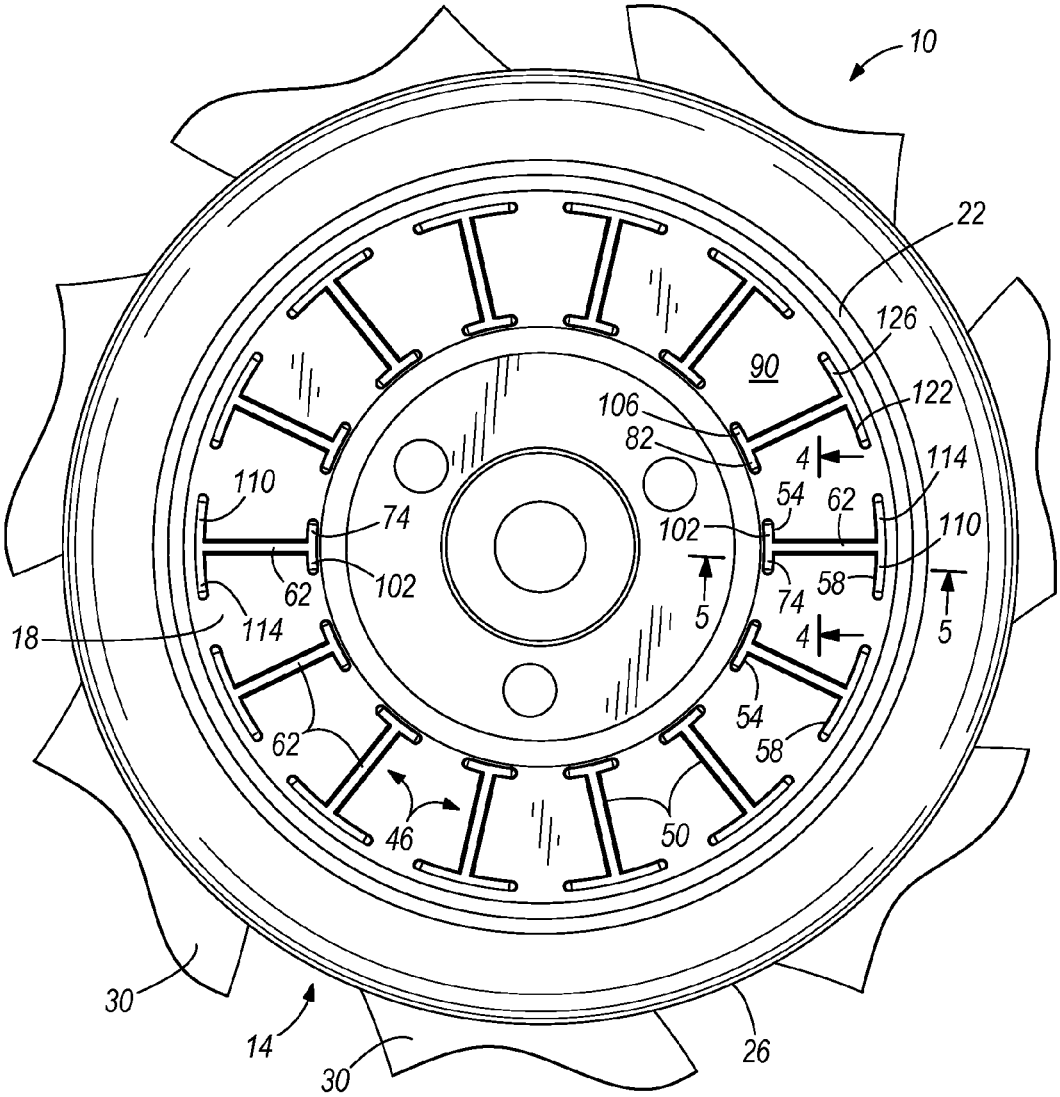
FIG. 3 is a front view of a portion of the axial flow fan of FIG. 1.

With reference to FIGS. 1 and 3, the fan 10 includes a plurality of isolation apertures or slots 46 through the front face 18 of the hub 14. In the illustrated construction of the axial flow fan 10, the slots 46 are evenly distributed or arrayed about the central axis 16 to attenuate or damp any NVH emanated by the fan 10. Alternatively, the slots 46 may be unevenly distributed about the central axis 16, or distributed on the hub 14 in any of a number of different ways or patterns according to the particular NVH characteristics of the fan 10. Each of the slots 46 is generally shaped as an "I," having a radially-extending portion 50 disposed between spaced generally laterally-extending portions 54, 58. In the illustrated construction of the fan 10, each of the laterally-extending portions 54, 58 of each of the slots 46 is oriented circumferentially with respect to the central axis 16. However, the laterally-extending portions 54, 58 are each generally oriented at a right angle with respect to the length of the radially-extending portion 50 of the slot 46. Further, the laterally-extending portion 54 of each of the slots 46 nearer the central axis 16 has a shorter circumferential length than the laterally-extending portion 58 of the respective slots 46 further from the central axis 16. Alternatively, the laterally-extending portions 54, 58 of the slots 46 may have different lengths than that shown in the drawings.

Figure 4:
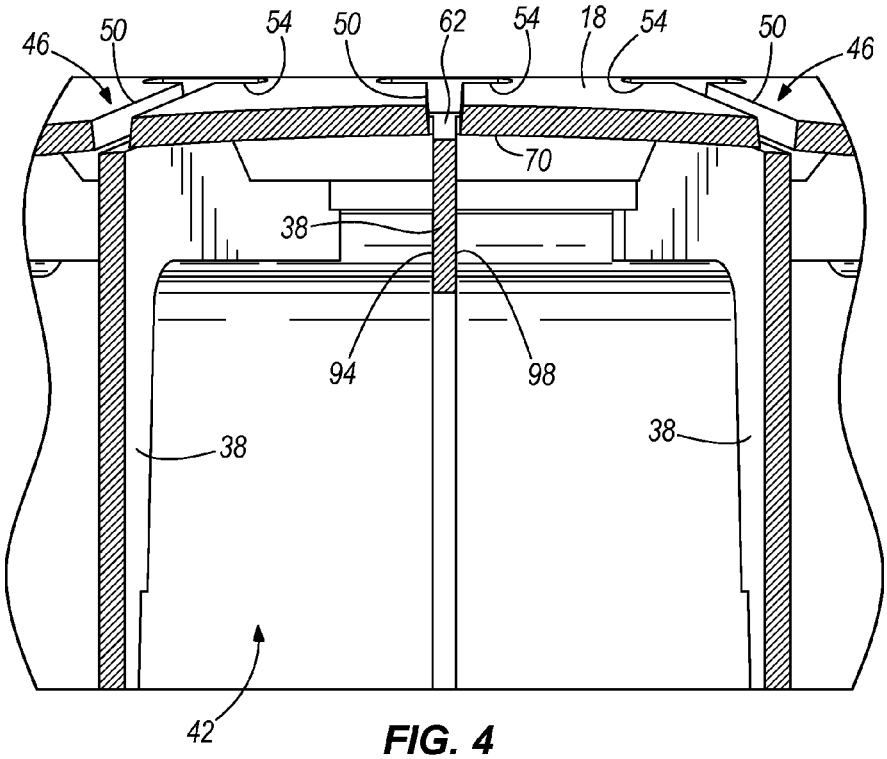
FIG. 4 is a cross-sectional view of the axial flow fan of FIG. 1 along line 4-4 in FIG. 3.

With respect to FIG. 4, the ribs 38 are angularly aligned, with respect to the central axis 16, with the radially-extending portion 50 of the respective slots 46. In addition, each of the ribs 38 includes a free edge 62 that lies in a plane 66 substantially parallel to and spaced from an interior surface 70 of the front face 18 (see FIG. 5). As a result, the free edge 62 of each of the ribs 38 is unattached to the interior surface 70 of the front face 18 along the length of the radially-extending portion 50 of the slot 46 with which the ribs 38 are associated.

Figure 5:
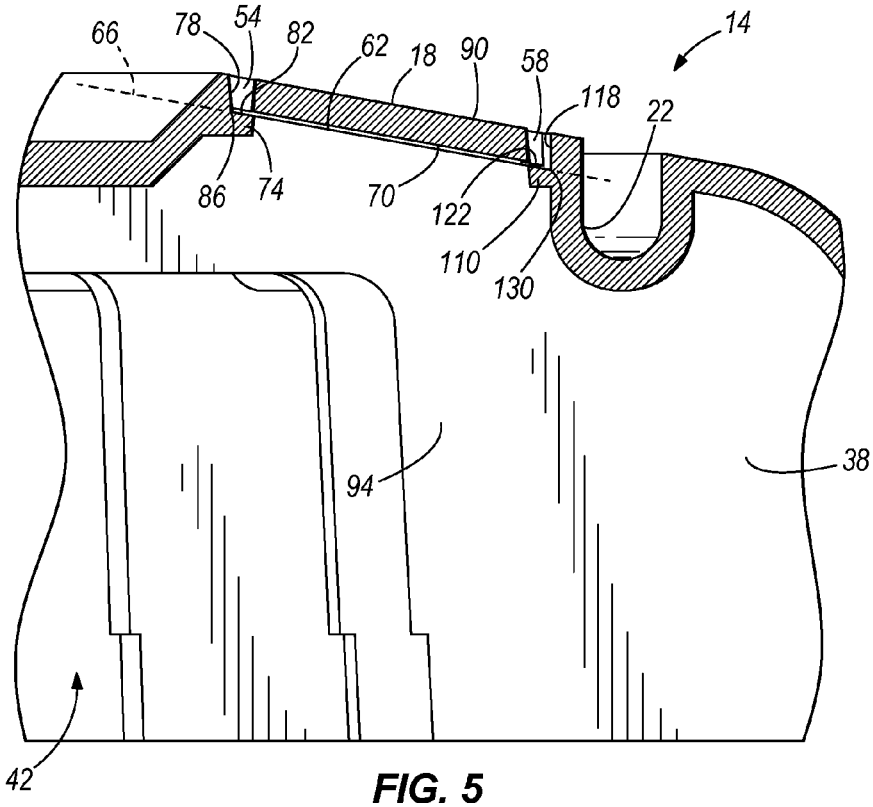
FIG. 5 is a cross-sectional view of the axial flow fan of FIG. 1 along line 5-5 in FIG. 3.

With continued reference to FIG. 5, the axial fan 10 includes a lip 74 at least partially overlapping the laterally-extending portion 54 of each of the slots 46. Specifically, the laterally-extending portion 54 of each of the slots 46 is at least partially defined by a first surface 78 oriented non-parallel with the front face 18, and the lip 74 includes a second surface 82 adjacent the first surface 78 that at least partially overlaps the laterally-extending portion 54 of the slot 46. In other words, the first surface 78 and the second surface 82 share a common edge 86 or intersect each other at the common edge 86. Further, the lip 74 overlaps the laterally-extending portion 54 of the slot 46 on the interior side 42 of the hub 14, such that the lip 74 extends over, underlies, or covers at least a portion of the laterally-extending portion 54 of the slot 46 proximate the interior surface 70 of the front face 18. Alternatively, the lip 74 may be positioned to overlap, overlie, or cover at least a portion of the laterally-extending portion 54 of the slot 46 proximate an exterior surface 90 of the front face 18.

In the illustrated construction of the axial fan 10, the second surface 82 of each lip 74 is substantially coplanar with the plane 66 and the free edge 62 of the rib 38 with which the lip 74 is associated. Consequently, the second surface 82 of each of the lips 74 is also unattached to the interior surface 70 of the front face 18 along the length of the laterally-extending portion 54 of each of the respective slots 46. Alternatively, the second surface 82 may be misaligned with the plane 66, such that the second surface 82 is disposed either above or below the plane 66.

With reference to FIG. 4, each of the ribs 38 includes opposed first and second sides 94, 98 defining therebetween the thickness of the rib 38. While the lip 74 shown in cross-section in FIG. 5 is coupled to and extends from the first side 94 of the rib 38, the axial fan 10 includes a second lip 102 coupled to and extending from the second side 98 of each of the ribs 38 (see FIG. 2). In a similar manner as the first lip 74, the second lip 102 includes a third surface 106 (see FIG. 3) adjacent the first surface 78 to at least partially overlap or underlie the laterally-extending portion 54 of the slot 46. The first and second lips 74, 102 are substantially identical, such that the respective surfaces 82, 106 of the lips 74, 102 are coplanar with each other and coplanar with the free edge 62 of the respective rib 38 to which the lips 74, 102 are coupled. As a result, the respective surfaces 82, 106 of the first and second lips 74, 102 and the free edge 62 of the associated rib 38 appear to be a continuous surface along the length of the laterally-extending portion 54 of each of the slots 46. Alternatively, the respective surfaces 82, 106 of the lips 74, 102 may not be coplanar with the free edge 62 of the rib 38, such that the collective surfaces of the lips 74, 102 and the rib 38 when viewed through the laterally-extending portion 54 of each of the slots 46 would appear to be discontinuous. As a further alternative, the lips 74, 102 may be combined and formed as a single, continuous piece that is separate and distinct from the rib 38.

With reference to FIG. 5, the axial fan 10 includes a third lip 110 extending from the first side 94 of each of the ribs 38, and a fourth lip 114 (see FIGS. 2 and 3) extending from the second side 98 of each of the ribs 38 to at least partially overlap the laterally-extending portion 58 of each of the slots 46. Specifically, the laterally-extending portion 58 of each of the slots 46 is at least partially defined by a surface 118 (see FIG. 5) oriented non-parallel with the front face 18, and each of the lips 110, 114 includes a surface 122, 126 adjacent the surface 118 that at least partially overlaps the laterally-extending portion 58 of the slot 46. In other words, the respective surfaces 118, 122 and 118, 126 share a common edge 130 or intersect each other at the common edge 130. Further, the lips 110, 114 overlap the laterally-extending portion 58 of the slot 46 on the interior side 42 of the hub 14, such that the lips 110, 114 extend over, underlie, and cover at least a portion of the laterally-extending portion 58 of the slot 46 proximate the interior surface 70 of the front face 18. Alternatively, one or both of the lips 110, 114 may be positioned to overlap or cover at least a portion of the laterally-extending portion 58 of the slot 46 proximate the exterior surface 90 of the front face 18.

In the illustrated construction of the axial fan 10, the respective surfaces 122, 126 of the lips 110, 114 are substantially coplanar with the plane 66 and the free edge 62 of the ribs 38 with which the lips 110, 114 are associated. Consequently, the respective surfaces 122, 126 of the lips 110, 114 are also unattached to the interior surface 70 of the front face 18 along the length of the laterally-extending portion 58 of each of the respective slots 46.

The third and fourth lips 110, 114 are substantially identical, such that the respective surfaces 122, 126 of the lips 110, 114 are coplanar with each other and coplanar with the free edge 62 of the respective rib 38 to which the lips 110, 114 are coupled. As a result, the respective surfaces 122, 126 of the third and fourth lips 110, 114 and the free edge 62 of the associated rib 38 appear to be a continuous surface along the length of the laterally-extending portion 58 of each of the slots 46. Alternatively, the respective surfaces 122, 126 of the lips 110, 114 may not be coplanar with the free edge 62 of the rib 38, such that the collective surfaces 122, 126 of the lips 118, 122 and the free edge 62 of the rib 38 when viewed through the laterally-extending portion 58 of each of the slots 46 would appear to be discontinuous. As a further alternative, the lips 110, 114 may be combined and formed as a single, continuous piece that is separate and distinct from the rib 38.

In the illustrated construction of the axial fan 10, the lips 74, 102, 110, 114 are integrally formed with the ribs 38 and the front face 18 as a single piece (e.g., using a molding process, a casting process, etc.). Alternatively, the lips 74, 102, 110, 114 may be configured as separate and distinct components from the ribs 38 and the front face 18, and the separate lips 74, 102, 110, 114 may be attached to the front face 18 in any of a number of different ways (e.g., by fastening, welding, brazing, adhering, etc.). As a further alternative, some or all of the lips 74, 102, 110, 114 may be integrally formed on an intermediate plate, and the intermediate plate may be attached to the front face 18 in any of a number of different ways (e.g., by fastening, welding, brazing, adhering, etc.).

During the operation of the axial flow fan 10, the combination of the free edges 62 of the respective ribs 38 being aligned with the corresponding radially-extending portions 50 of each of the slots 46, and the lips 74, 102 and 110, 114 overlapping the laterally-extending portions 54, 58 of each of the slots 46, provides a tortuous passageway through each of the slots 46, thereby reducing the amount of water or liquid intrusion through the front face 18 of the hub 14. In other words, any water that may enter the slots 46 from the exterior surface 90 cannot pass directly through the front face 18 and the interior 42 of the hub 14 via a straight-line pathway. The surfaces 82, 106, 122, 126 and the free edges 62 of the respective ribs 38 prevent any straight-line passage of water through the front face 18. This functionality is achieved while at the same time not affecting the attenuating or damping function of the isolation slots 46.

Figure 6:
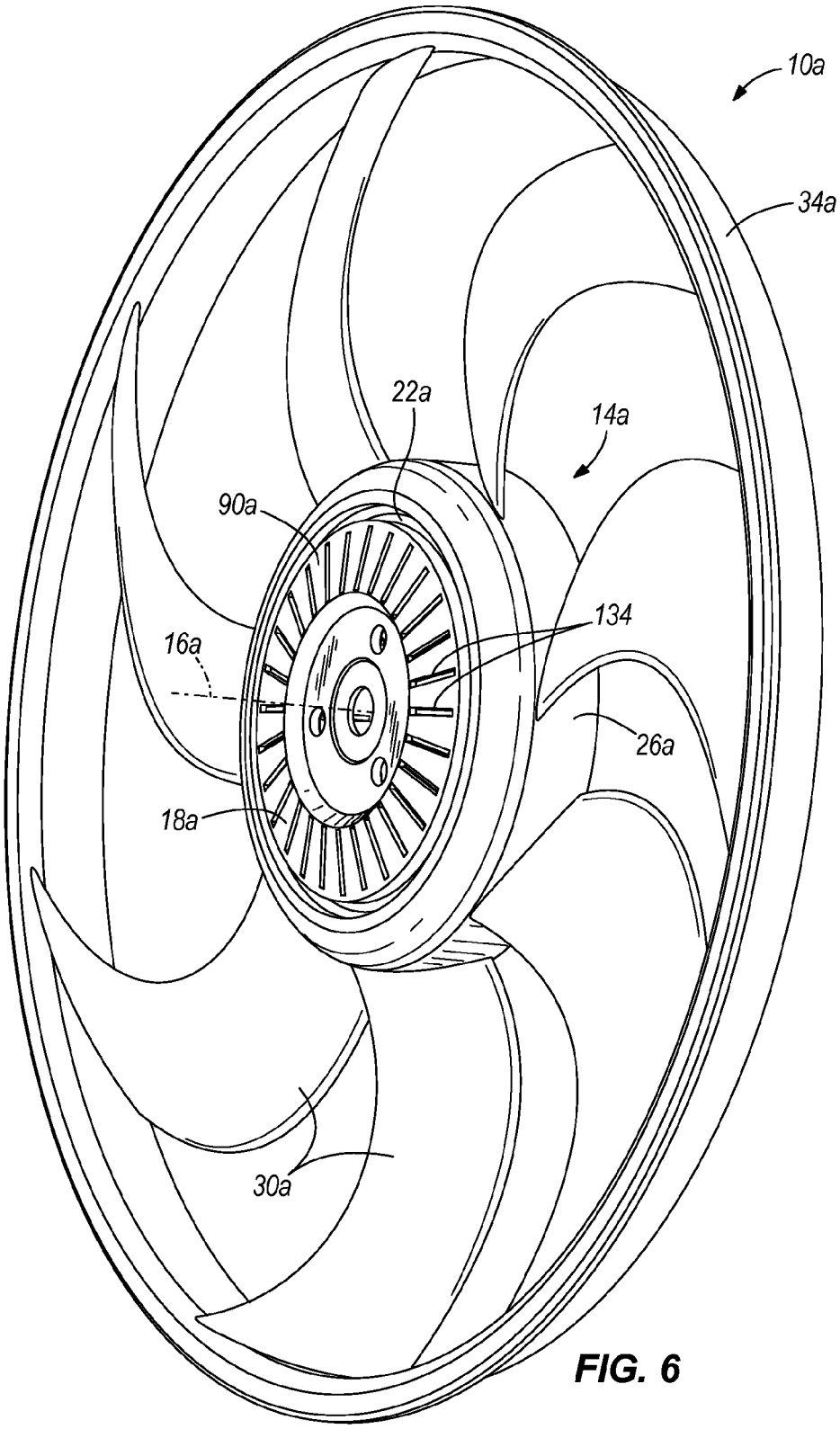
FIG. 6 is a front perspective view of a second construction of an axial flow fan of the invention.
Figure 8:
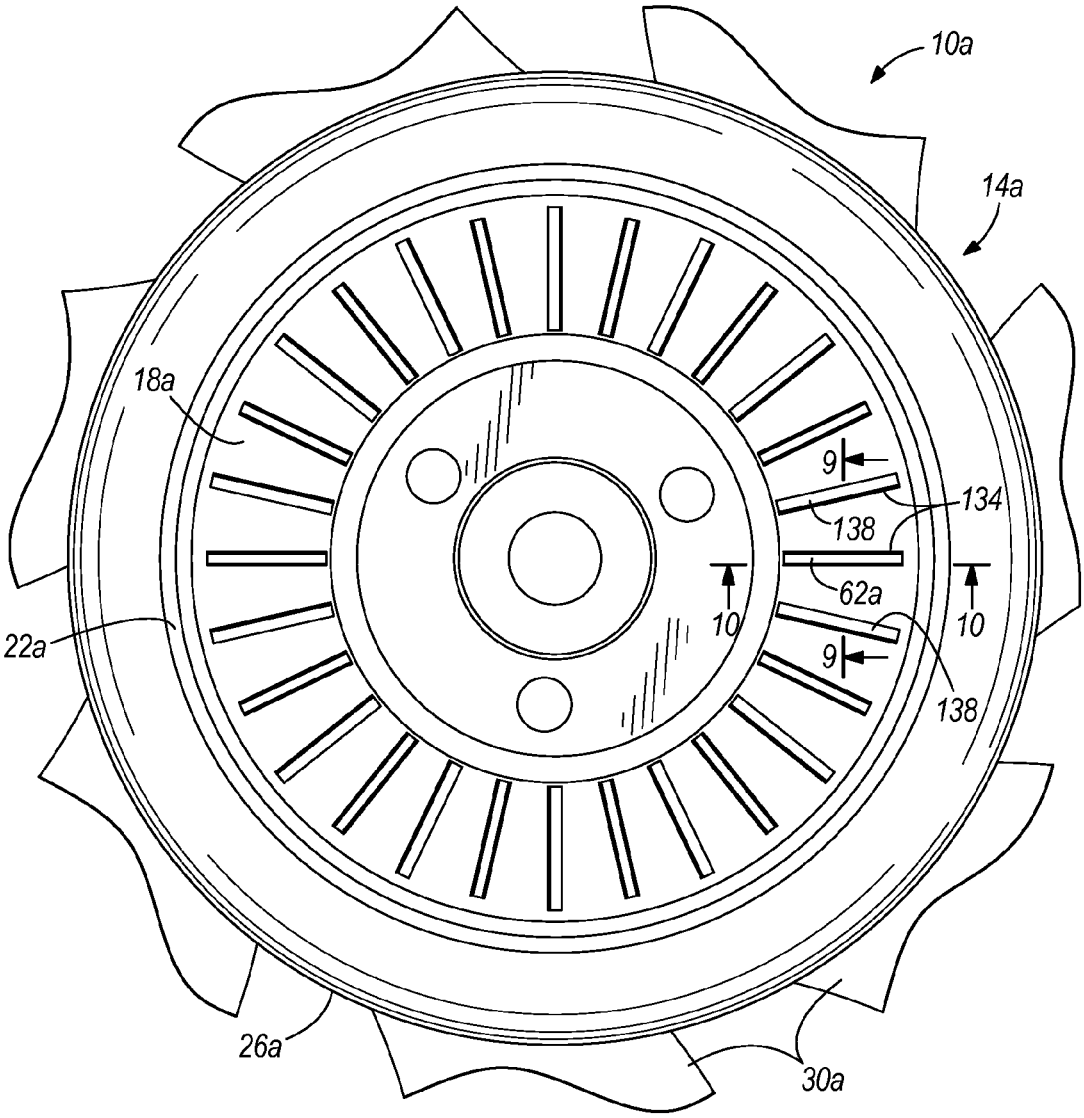
FIG. 8 is a front view of a portion of the axial flow fan of FIG. 6.

FIG. 6 illustrates a second construction of an axial flow fan 10*a* of the invention, with like components being labeled with like reference numerals, with the letter "a." With reference to FIGS. 6 and 8, the fan 10*a* includes a plurality of isolation apertures or slots 134 through the front face 18*a* of the hub 14*a*. In the illustrated construction of the axial flow fan 10*a*, the slots 134 are evenly distributed or arrayed about the central axis 16*a* to attenuate or damp any NVH emanated by the fan 10*a*. Alternatively, the slots 134 may be unevenly distributed about the central axis 16*a*, or distributed on the hub 14*a* in any of a number of different ways or patterns according to the particular NVH characteristics of the fan 10*a*. Each of the slots 134 is oriented on the front face 18*a* in a radial direction with respect to the central axis 16*a*.

Figure 7:
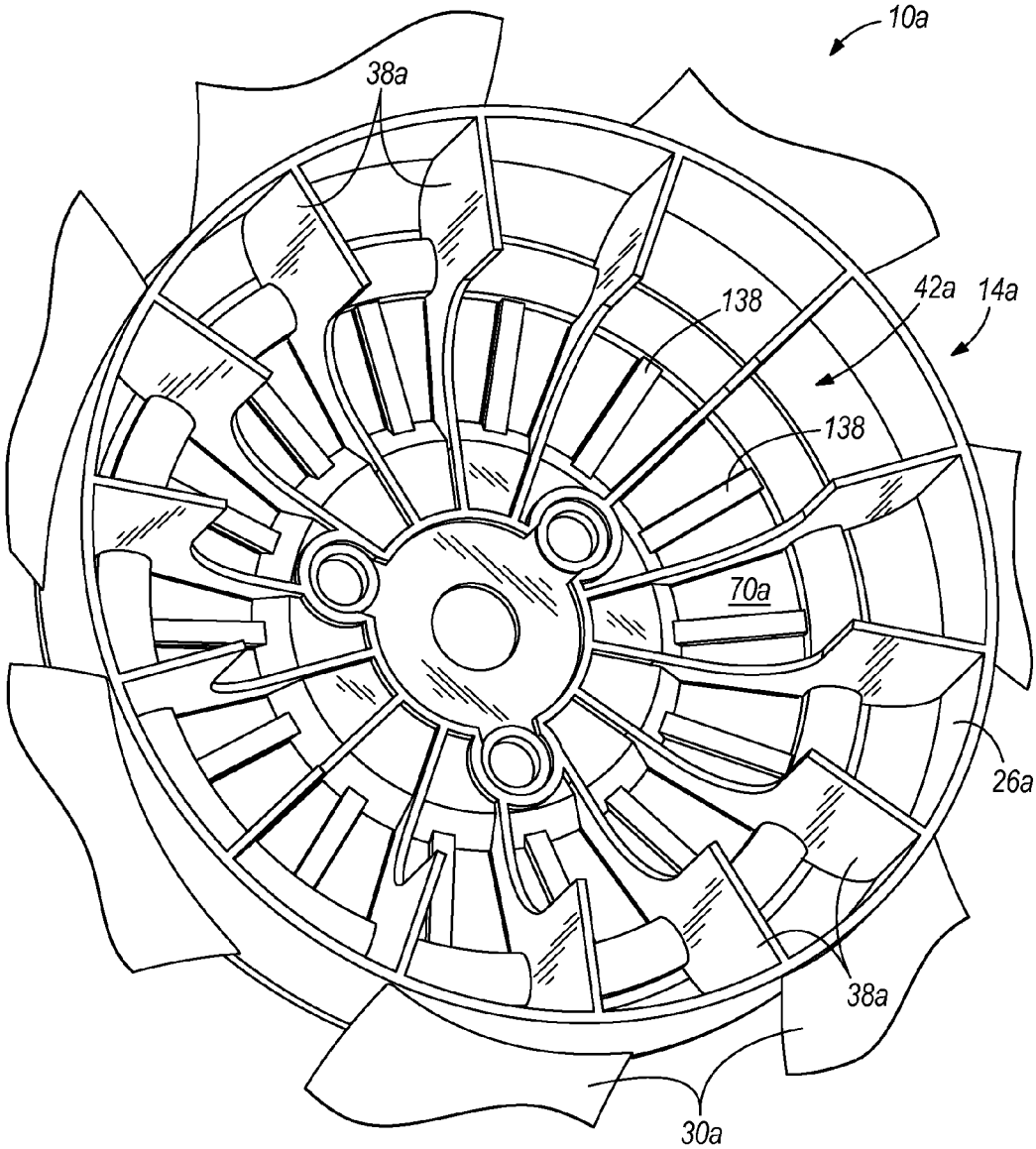
FIG. 7 is a rear perspective view of a portion of the axial flow fan of FIG. 6.
Figure 9:
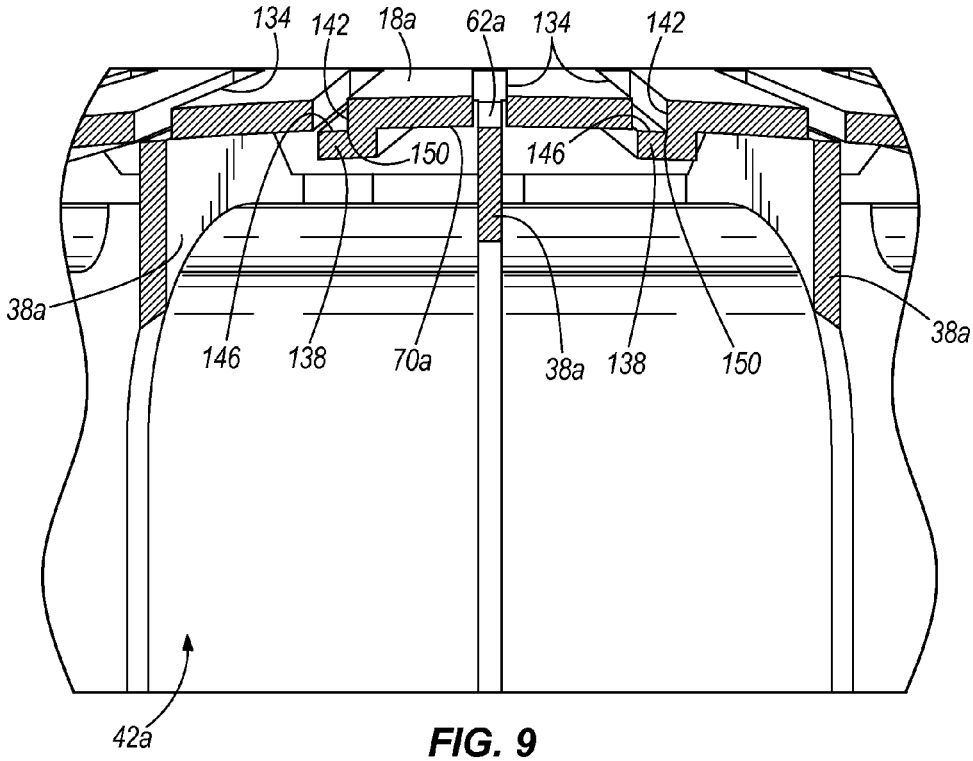
FIG. 9 is a cross-sectional view of the axial flow fan of FIG. 6 along line 9-9 in FIG. 8.
Figure 10:
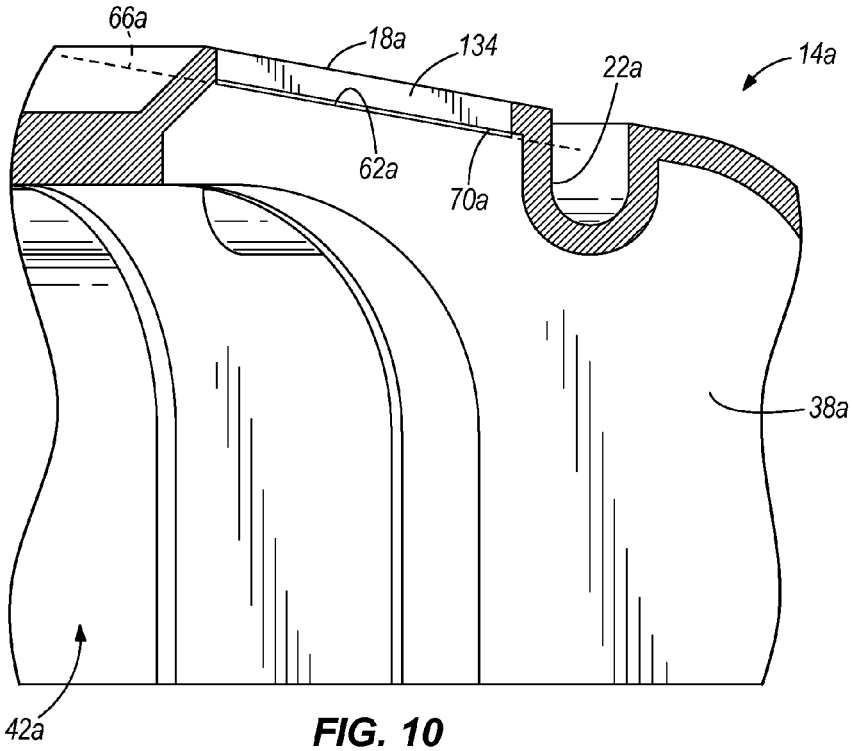
FIG. 10 is a cross-sectional view of the axial flow fan of FIG. 6 along line 10-10 in FIG. 8.

With reference to FIGS. 7 and 9, the ribs 38*a* are angularly aligned, with respect to the central axis 16, with only some of the slots 134. Particularly, the ribs 38*a* are angularly aligned with every other slot 134 or alternating slots 134 in the array. Alternatively, the ribs 38*a* may be aligned with some of the slots 134 in any of a number of different patterns. With reference to FIG. 10, each of the ribs 38*a* includes a free edge 62*a* that lies in a plane 66*a* substantially parallel to and spaced from an interior surface 70*a* of the front face 18*a*. As a result, the free edge 62*a* of each of the ribs 38*a* is unattached to the interior surface 70*a* of the front face 18*a* along the length of the slot 134.

With reference to FIG. 9, the axial fan 10*a* includes a lip 138 at least partially overlapping each of the slots 134 which are not aligned with a corresponding rib 38*a*. Specifically, each of the slots 134 is at least partially defined by a surface 142 oriented non-parallel with the front face 18*a*, and the lip 138 includes a surface 146 adjacent the surface 142 that at least partially overlaps the slot 134. In other words, the two surfaces 142, 146 share a common edge 150 or intersect each other at the common edge 150. Further, the lip 138 overlaps the slot 134 on the interior side 42*a* of the hub 14*a*, such that the lip 138 extends over, underlies, and covers at least a portion of the slot 134 proximate the interior surface 70*a* of the front face 18*a*. Alternatively, the lip 138 may be positioned to overlap, overlie, or cover at least a portion of the slot 134 proximate an exterior surface 90*a* of the front face 18*a*.

In the illustrated construction of the axial fan 10*a*, the surface 146 of each of the lips 138 is spaced from the interior surface 70*a* of the front face 18*a* in a direction parallel with the central axis 16*a*. Consequently, the surface 146 of each of the lips 138 is unattached to the interior surface 70*a* of the front face 18*a* along the length of the slot 134. In the illustrated construction of the axial fan 10*a*, the lips 138 are integrally formed with the front face 18*a* as a single piece (e.g., using a molding process, a casting process, etc.). Alternatively, the lips 138 may be configured as separate and distinct components from the front face 18*a*, and the separate lips 138 may be attached to the front face 18*a* in any of a number of different ways (e.g., by fastening, welding, brazing, adhering, etc.). As a further alternative, some or all of the lips 138 may be integrally formed on an intermediate plate, and the intermediate plate may be attached to the front face 18*a* in any of a number of different ways (e.g., by fastening, welding, brazing, adhering, etc.).

During the operation of the axial flow fan 10*a*, the combination of the free edges 62*a* of the respective ribs 38*a* being aligned with some of the slots 134, and the lips 138 overlapping the remainder of the slots 134, provides a tortuous passageway through each of the slots 134, thereby reducing the amount of water or liquid intrusion through the front face 18*a* of the hub 14*a*. In other words, any water that may enter the slots 134 from the exterior surface 90*a* cannot pass directly through the front face 18*a* and the interior 42*a* of the hub 14*a* via a straight-line pathway. The surfaces 146 of the respective lips 138 and the free edges 62*a* of the respective ribs 38*a* prevent any straight-line passage of water through the front face 18*a*. This functionality is achieved while at the same time not affecting the attenuating or damping function of the isolation slots 134.

Various features of the invention are set forth in the following claims.

What is claimed is:

1. An axial flow fan comprising:

a hub rotatable about a central axis, the hub including a front face and a cylindrical portion;

a plurality of blades extending radially outwardly from the cylindrical portion of the hub;

a plurality of apertures through the front face of the hub, each aperture at least partially defined by a first surface oriented non-parallel with the front face;

a plurality of ribs, each rib extending radially along an interior surface of the front face of the hub and aligned with one of the plurality of apertures such that a free edge of the rib at least partially overlaps the respective one of the plurality of apertures and provides a tortuous passageway through the respective aperture; and a plurality of lips, each lip coupled to the front face of the hub and aligned with one of the plurality of apertures that is not aligned with one of the plurality of ribs, each lip having a second surface, adjacent the first surface of a respective aperture, that at least partially overlaps the respective aperture and provides a tortuous passageway through the aperture.

2. The axial flow fan of claim 1, wherein the plurality of ribs alternate with the plurality of lips such that each rib is positioned between two adjacent lips and each lip is positioned between two adjacent ribs.

3. The axial flow fan of claim 1, wherein each respective first surface of an aperture and adjacent second surface of a lip share a common edge extending radially with respect to the central axis.

4. The axial flow fan of claim 3, wherein each respective first surface of an aperture and adjacent free edge of a rib do not share a common edge.

5. The axial flow fan of claim 1, wherein each respective first surface of an aperture and adjacent second surface of a lip share a first common edge extending radially with respect to the central axis, wherein each aperture is at least partially further defined by a third surface oriented non-parallel with the front face, and wherein each respective third surface of an aperture and adjacent free edge of a rib share a second common edge extending transverse to the first common edge.

6. The axial flow fan of claim 1, wherein each respective first surface of an aperture and adjacent second surface of a lip share a common edge.

7. The axial flow fan of claim 1, wherein each respective first surface of an aperture and adjacent second surface of a lip are substantially perpendicular to one another.

8. The axial flow fan of claim 1, wherein each lip at least partially overlaps a respective aperture on an interior side of the hub.

9. The axial flow fan of claim 1, wherein each second surface lies in a plane substantially parallel to and spaced from the interior surface of the front face.

10. The axial flow fan of claim 1, wherein each of the plurality of apertures extends radially with respect to the central axis.

11. The axial flow fan of claim 10, wherein the apertures are radially-extending slots.

12. The axial flow fan of claim 1, wherein each of the plurality of ribs and each of the plurality of lips are integrally formed as part of the hub.

13. The axial flow fan of claim 1, wherein each free edge lies in a plane substantially parallel to and spaced from the interior surface of the front face.

14. The axial flow fan of claim 1, wherein each of the plurality of ribs extends into contact with the cylindrical portion of the hub, and wherein each of the plurality of lips is coupled with the front face of the hub without contacting the cylindrical portion of the hub.

15. The axial flow fan of claim 1, wherein the plurality of apertures are evenly distributed in the front face of the hub about the central axis.

16. The axial flow fan of claim 1, wherein every one of the plurality of apertures is overlapped by one of the plurality of ribs or one of the plurality of lips.

17. The axial flow fan of claim 1, wherein each of the plurality of ribs has a radial length that is longer than a radial length of each of the plurality of apertures, and wherein each of the plurality of lips has a radial length shorter than the radial length of each of the ribs.

18. The axial flow fan of claim 1, wherein the apertures are slots.

* * * * *